US005772393A

United States Patent [19]

Nakamura et al.

[11] Patent Number: 5,772,393

[45] Date of Patent: Jun. 30, 1998

[54] LOW NOISE FUEL PUMP UNIT

[75] Inventors: Takehide Nakamura; Shinichi Fujii; Koichi Iwata; Satoru Ikeda, all of Obu, Japan

[73] Assignee: Aisan Kogyo Kabushiki Kaisha, Obu, Japan

[21] Appl. No.: 732,925

[22] Filed: Oct. 17, 1996

[30] Foreign Application Priority Data

Oct. 27, 1995 [JP] Japan ..... 7-280749

[51] Int. Cl.[6] ..... F01D 1/12

[52] U.S. Cl. ..... 415/55.4; 415/55.2

[58] Field of Search ..... 415/55.1, 55.2, 415/55.3, 55.4

[56] References Cited

U.S. PATENT DOCUMENTS

| | | | |
|---|---|---|---|
| 4,408,952 | 10/1983 | Schweinfurter | 415/53 T |
| 4,412,781 | 11/1983 | Abe et al. | 415/53 R |
| 5,273,394 | 12/1993 | Samuel | 415/55.1 |
| 5,281,083 | 1/1994 | Ito et al. | 415/55.1 |
| 5,449,270 | 9/1995 | Levi et al. | 415/55.3 |

FOREIGN PATENT DOCUMENTS 7-62478 7/1995 Japan .

*Primary Examiner*—Thomas E. Denion

*Attorney, Agent, or Firm*—Dennison, Meserole, Pollack & Scheiner

[57] ABSTRACT

In a fuel pump unit including a substantially disc-like rotating impeller, a pump casing for accommodating the impeller, the pump casing having a pressurizing passage surrounding an outer peripheral edge of the impeller and extending along the outer peripheral edge from its upstream end to downstream end, an inlet hole communicating with the upstream end of the pressurizing passage, an outlet hole communicating with the downstream end of the pressurizing passage, and a partition wall formed at a range circumpherentially upstream of the upstream end and downstream of the downstream end of the pressurizing passage, the improvement comprises a cutout slot formed at an end of the partition wall facing the outlet hole, the width of the cutout slot in an axial direction being gradually reduced as the cutout slot extends from the end of the partition wall in a circumferentially downstream direction.

6 Claims, 9 Drawing Sheets

LOW NOISE FUEL PUMP UNIT

BACKGROUND OF THE INVENTION

1. Field of the Invention

The present invention relates to a regenerative fuel pump unit.

2. Description of the Prior Art

A conventional fuel pump unit will be described with reference to FIGS. 6 to 9. FIG. 6 is a vertical cross-sectional view taken along line VI—VI of FIG. 7. FIG. 7 is a horizontal cross-sectional view taken along line VII—VII of FIG. 6. FIGS. 8(*a*), 8(*b*), 8(*c*), 8(*d*) and 8(*e*) are views taken along line VIII*a*—VIII*a*, VIII*b*—VIII*b*, VIII*c*—VIII*c*, VIII*d*—VIII*d* and VIII*e*—VIII*e* of FIG. 7, respectively, each showing an explanatory sectional view of a flow passage. The fuel pump unit shown in FIG. 6 is a motor-driven regenerative fuel pump unit for pumping fuel from a fuel tank (not shown) for a motor vehicle.

The conventional fuel pump unit comprises a cylindrical housing 3, a motor section 1 incorporated in the housing 3, and a pump section 2 disposed under the motor section 1. In the motor section 1, a motor cover 4 and a pump cover 5 are mounted on the upper end and on the lower end of the housing 3, respectively. A motor chamber 6 is formed in the housing 3. An armature 7 is rotatably disposed in the motor chamber 6 such that upper and lower ends of an armature shaft 8 are supported by the motor cover 4 and the pump cover 5 via respective bearings 9 and 10. The housing 3 has a pair of magnets 11 fixed on the inside wall thereof.

A brush 13 is mounted to the motor cover 4. The brush 13 is biased by a spring 14 and the brush 13 is in sliding contact with a commutator 12 of the armature 7. The brush 13 is connected to an external connecting terminal (not shown) via a chalk coil 15.

A check valve 17 is incorporated in a fuel discharge port 16 provided in the motor cover 4. The fuel discharge port 16 is connected to a fuel supply pipe communicating with fuel injectors for a vehicle engine (not shown).

In the pump section 2, a pump body 18 is mounted on the lower side of the pump cover 5 by caulking the lower end of the housing 3. The pump body 18 and the pump cover 5 constitute a pump casing 50 for accommodating an impeller 21 to be described hereinafter.

The pump body 18 is provided with a fuel inlet hole 19 axially penetrating the pump body 18. The pump cover 5 is provided with a fuel outlet hole 20 axially penetrating the pump cover 5. The inlet hole 19 and the outlet hole 20 are located in a spaced relationship with each other in a circumferential direction of a pump chamber.

The pump casing 50 accommodates a substantially disc-shaped impeller 21 having a plurality of vane channels 22 on the outer periphery thereof. The impeller 21 is connected by fitting to the armature shaft 8 to be rotated therewith in a single direction.

As shown in FIG. 7, the pump cover 5 and the pump body 18 have respective flow grooves 24 at positions facing the vane channels 22. Specifically, the flow grooves 24 are formed along the outer periphery of the impeller 21 in a vertically symmetrical manner. Both the flow grooves 24 constitute a pressurizing passage 23 running from the inlet hole 19 to the outlet hole 20. The impeller 21 rotates in a direction from the inlet hole 19 via the pressurizing passage 23 to the outlet hole 20. The inlet hole 19 communicates with the upstream end of the pressurizing passage 23, and the outlet hole 20 communicates with the downstream end of the pressurizing passage 23.

A partition wall 25 is formed on the inner peripheral wall of the pump casing 50 (corresponding to the inner peripheral wall of the flow groove 24 of the pump cover 5), such that it is inwardly projected within a circumferentially narrower range between the inlet hole 19 and the outlet hole 20 and such that it has an arcuate surface 26 with substantially the same radius as that of the impeller 21. The partition wall 25 is formed at the location circumferentially upstream of the upstream end and circumferentially downstream of the downstream end of the pressurizing passage 23. The shape of the partition wall 25 is exemplarily shown in FIG. 9 which is a perspective view of the pump cover 5 viewed from the underside thereof. The partition wall 25 is formed for blocking the fuel flow between the inlet hole 19 and the outlet hole 20 not via the pressurizing passage 23.

As shown in FIGS. 7 and 8(*b*), a pressurizing passage 23 has a downstream portion 27 extending to the outlet hole 20 so that a clearance CL between the outer peripheral surface of the impeller 21 and the opposed peripheral wall surface of the portion 27 may be gradually increased (see Japanese Patent Publication No. 7-62478, for example).

In the fuel pump unit thus constructed, when the motor section 1 is energized to rotate the armature shaft 8, the impeller 21 is driven to rotate clockwise as shown in FIG. 7 (see a circular arrow). When the impeller 21 is rotated, the fuel stored in the fuel tank (not shown) is filtered by a fuel filter and sucked into the fuel inlet hole 19. The pressure of the fuel sucked from the inlet hole 19 is increased while the fuel is moved through the pressurizing passage 23 from the inlet hole 19 to the outlet hole 20, and the pressurized fuel is discharged into the fuel supply pipe via the outlet hole 20, the motor chamber 6, and the discharge port 16.

In the conventional fuel pump unit described above, the partition wall 25 has an angular end 25*a* (see FIGS. 7 and 9) on a side facing the outlet hole 20. Therefore, a fuel spiral vortex generated by the rotation of the impeller 21 is suddenly cut off at the angular end 25*a* when the fuel flows from the pressurizing passage 23 into the outlet hole 20. Specifically, the angular end 25*a* of the partition wall 25 corresponds to a dead point of the spiral vortex, thus causing a pump noise called impeller noise. As shown by arrows in FIG. 8(*a*) for example, the spiral vortex is a circulating flow of the fuel which flows outward in a radial direction of the impeller 21 along each vane channel 22 thereof until it collides against a radial wall surface of the pressurizing passage 23, and flows inward in the radial direction along the flow groove 24, and flows again outward in the radial direction along the vane channel 22. When this fuel spiral vortex is suddenly cut off at the angular end 25*a* of the partition wall 25, impeller noise is caused by the sudden change.

SUMMARY OF THE INVENTION

It is, accordingly, an object of the present invention to provide a fuel pump unit in which noise is reduced by reducing an impeller noise caused by a sudden cut-off of a fuel spiral vortex by the partition wall.

According to the present invention, a cutout slot is formed at an end of the partition wall facing the outlet hole. The axial width of the cutout slot is gradually reduced as the cutout slot extends in a circumferentially downstream direction.

According to the fuel pump unit having the cutout slot thus described, a spiral vortex of the fuel generated by the rotation of the impeller is gradually cut off by the cutout slot formed on the partition wall, thus avoiding a sudden cut-off of the spiral vortex at the end of the partition wall facing the outlet hole. Thus, the impeller noise caused by the sudden cut-off of the spiral vortex is reduced.

The present invention will be more fully understood from the following detailed description and appended claims when taken with the accompanying drawings.

BRIEF DESCRIPTION OF THE DRAWINGS

FIG. 3(*b*) is an inside view of the partition wall;

FIG. 3(*c*) is a sectional view taken along line C—C of FIG. 3(*b*);

DETAILED DESCRIPTION OF THE PREFERRED EMBODIMENTS

A fuel pump unit according to a first and a second embodiment of the present invention will now be described. The fuel pump units of the first and second embodiments are obtained by partly improving the above-described conventional pump unit (see FIG. 6). Parts that are the same as or similar to the conventional art are given like reference numbers, and their description will not be repeated.

[First Embodiment]

Figure 1:
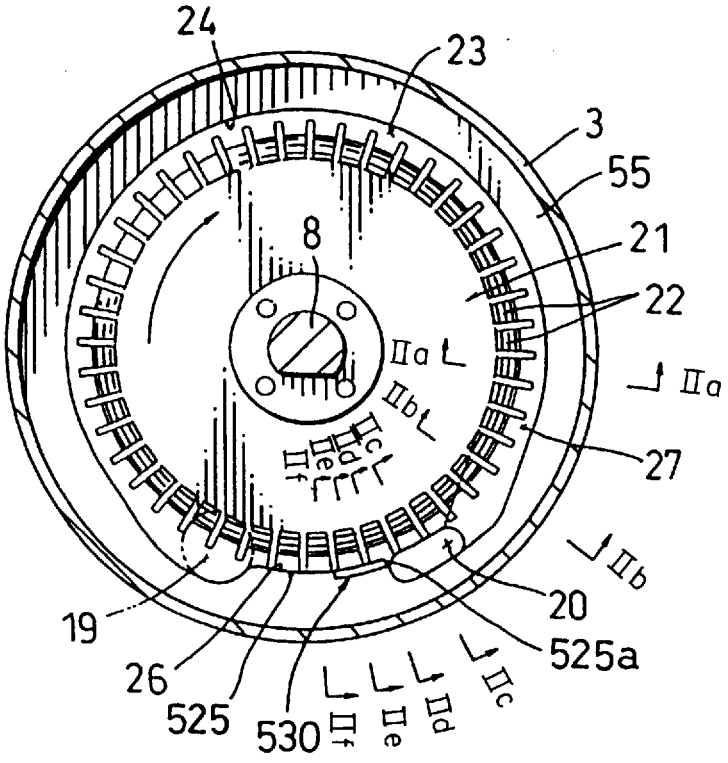
FIG. 1 is a horizontal cross-sectional view of the essential part of a fuel pump unit according to a first embodiment of the present invention.
Figure 2A:
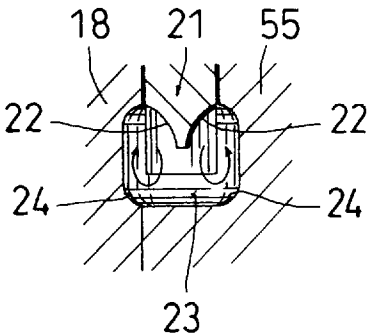
FIGS. 2(*a*) to 2(*f*) are sectional explanatory views of a flow passage taken along the respective lines II*a*—II*a* to II*f*—II*f* of FIG. 1.
Figure 2B:
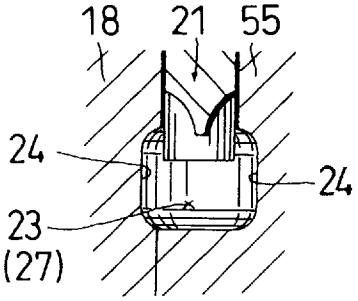
Figure 2C:
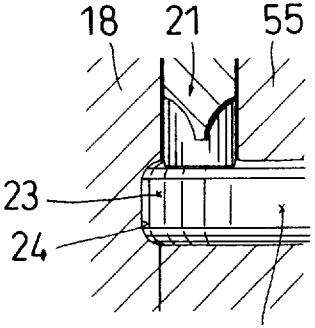
Figure 2D:
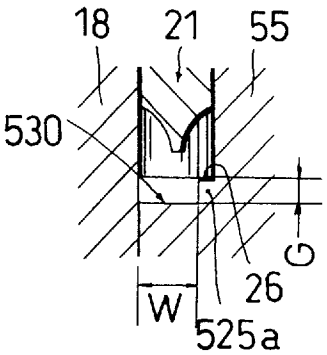
Figure 2E:
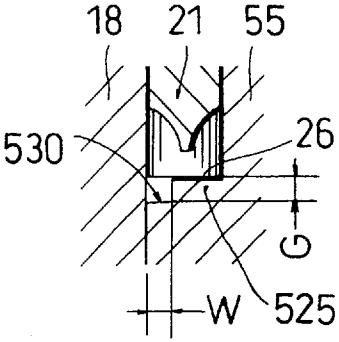
Figure 2F:
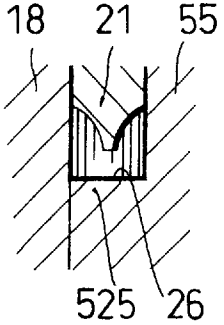
Figure 3A:
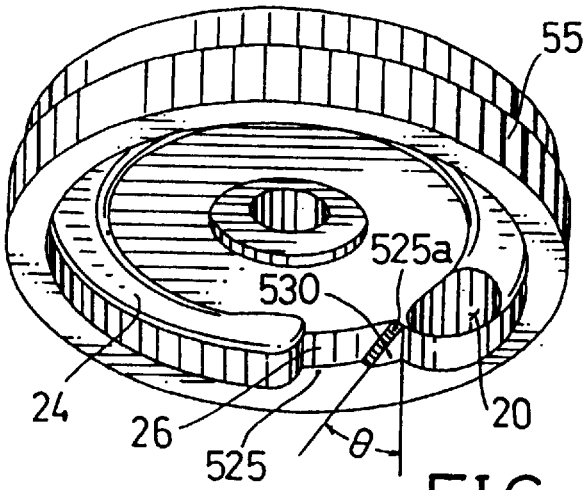
FIG. 3(*a*) is a perspective view of a pump cover 55 as viewed from the underside thereof.
Figure 3B:
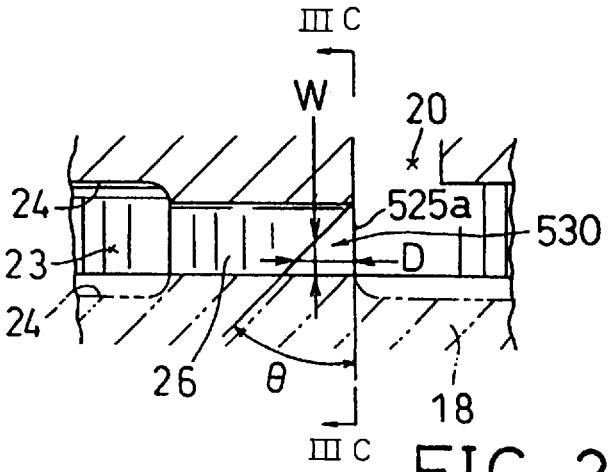
Figure 3C:
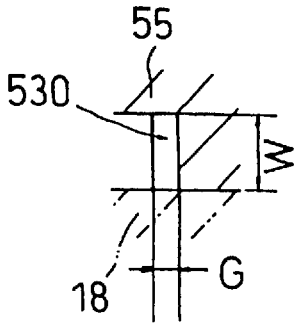
Figure 6:
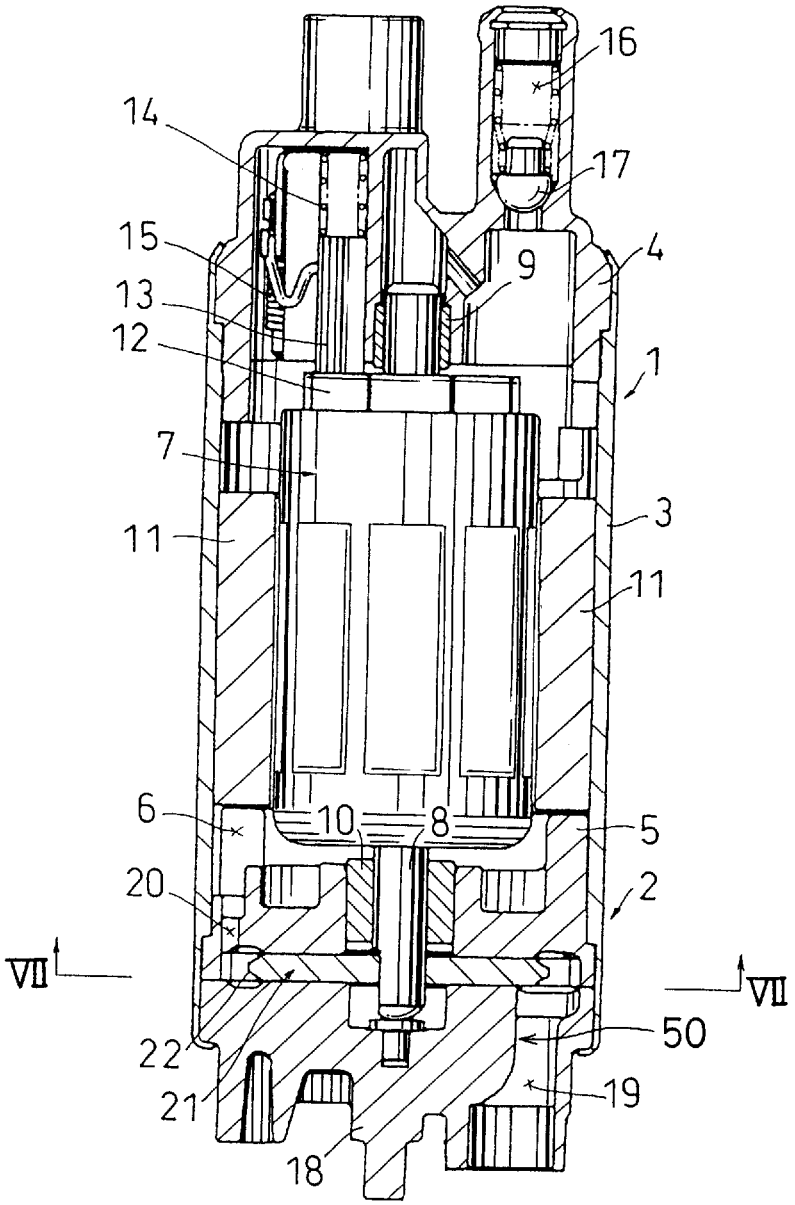
FIG. 6 PRIOR ART
FIG. 6 is a sectional view of a conventional fuel pump unit.
Figure 7:
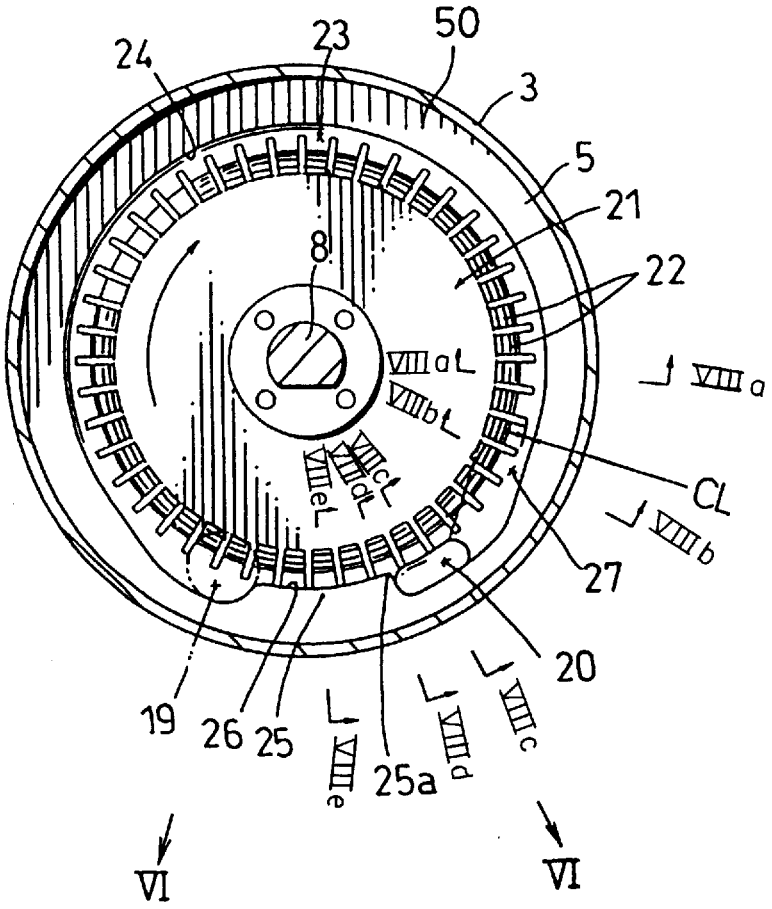
FIG. 7 PRIOR ART
FIG. 7 is a sectional view taken along line VII—VII of FIG. 6.
Figure 8A:
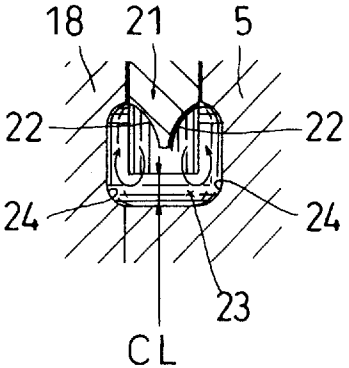
FIG. 8(a) PRIOR ART
FIGS. 8(*a*) to 8(*e*) are sectional explanatory views of a flow passage taken along the respective lines VIII*a*—VIII*a* to VIII*c*—VIII*c* of FIG. 7.
Figure 8B:
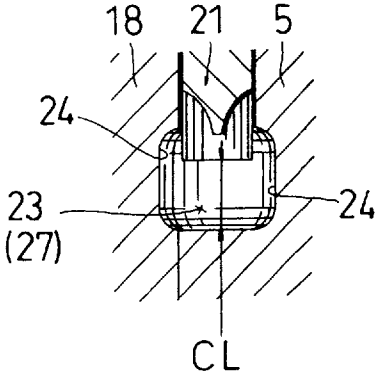
FIG. 8(b) PRIOR ART
Figure 8C:
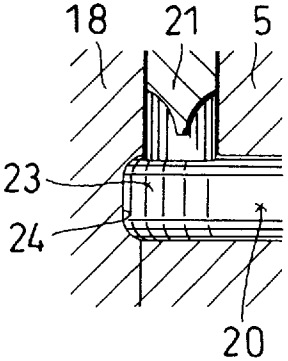
FIG. 8(c) PRIOR ART
Figure 8D:
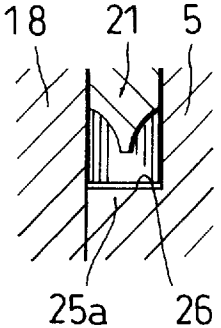
FIG. 8(d) PRIOR ART
Figure 8E:
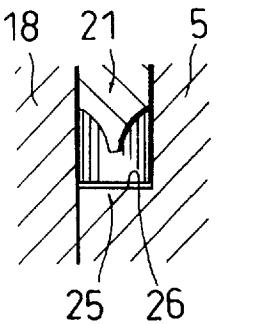
FIG. 8(e) PRIOR ART
Figure 9:
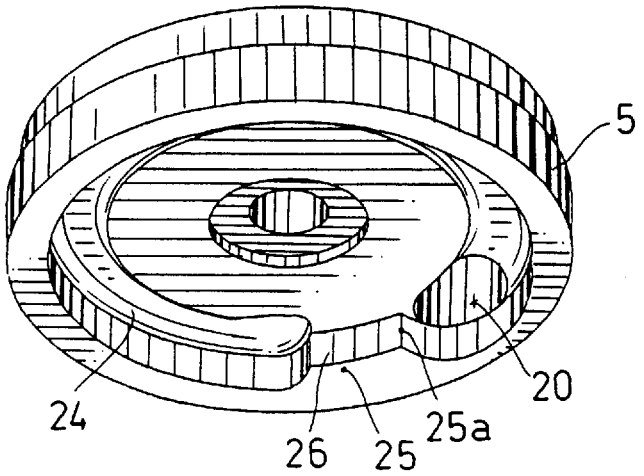
FIG. 9 PRIOR ART
FIG. 9 is a perspective view of a pump cover of FIG. 6 viewed from the underside thereof.

FIG. 1 shows the essential part of the fuel pump unit of the first embodiment, corresponding to a view taken along line VII—VII of FIG. 6. FIGS. 2(*a*), 2(*b*), 2(*c*), 2(*d*), 2(*e*) and 2(*f*) are sectional explanatory views of a flow passage taken along the respective lines II*a*—II*a*-, II*b*—II*b*, II*c*—II*c*, II*d*—II*d*, II*e*—II*e*, II*f*—II*f* of FIG. 1. FIG. 3(*a*) is a perspective view of a pump cover 55 as viewed from the underside thereof, FIG. 3(*b*) is an inside view of a partition wall, and FIG. 3(*c*) is a sectional view taken along line III*b*—III*b* of FIG. 3(*b*).

As best shown in FIGS. 1, 2(*d*), 2(*e*), and 3(*a*) to 3(*c*), a partition wall 525 of the first embodiment is provided with a cutout slot 530 having a radial cutout depth G. The cutout slot 530 is formed at an end 525*a* of a wall surface 26 (labeled with the same number as an arcuate surface) of the partition wall 525 facing the outlet hole 20. The cutout slot 530 is formed such that a cutout angle θ thereof is about 45° inclined to its axis, and such that the axial width W thereof is gradually reduced from the end 525*a* in the circumferentially downstream direction. As clearly shown in FIG. 3(*b*), an inner peripheral edge of the cutout slot 530 is made linear. The circumferential length D of the cutout slot 530 is axially changed.

By the above-described design of the fuel pump unit, the spiral vortex of the fuel generated by the rotation of the impeller 21 is gradually cut off at the cutout slot 530 of the partition wall 525, thus preventing the spiral vortex from being suddenly cut off at the end 525*a* of the partition wall 525 facing the outlet hole 20. Accordingly, it is possible to reduce the impeller noise caused by the sudden cut-off of the spiral vortex, thus permitting noise reduction of the fuel pump.

Figure 4:
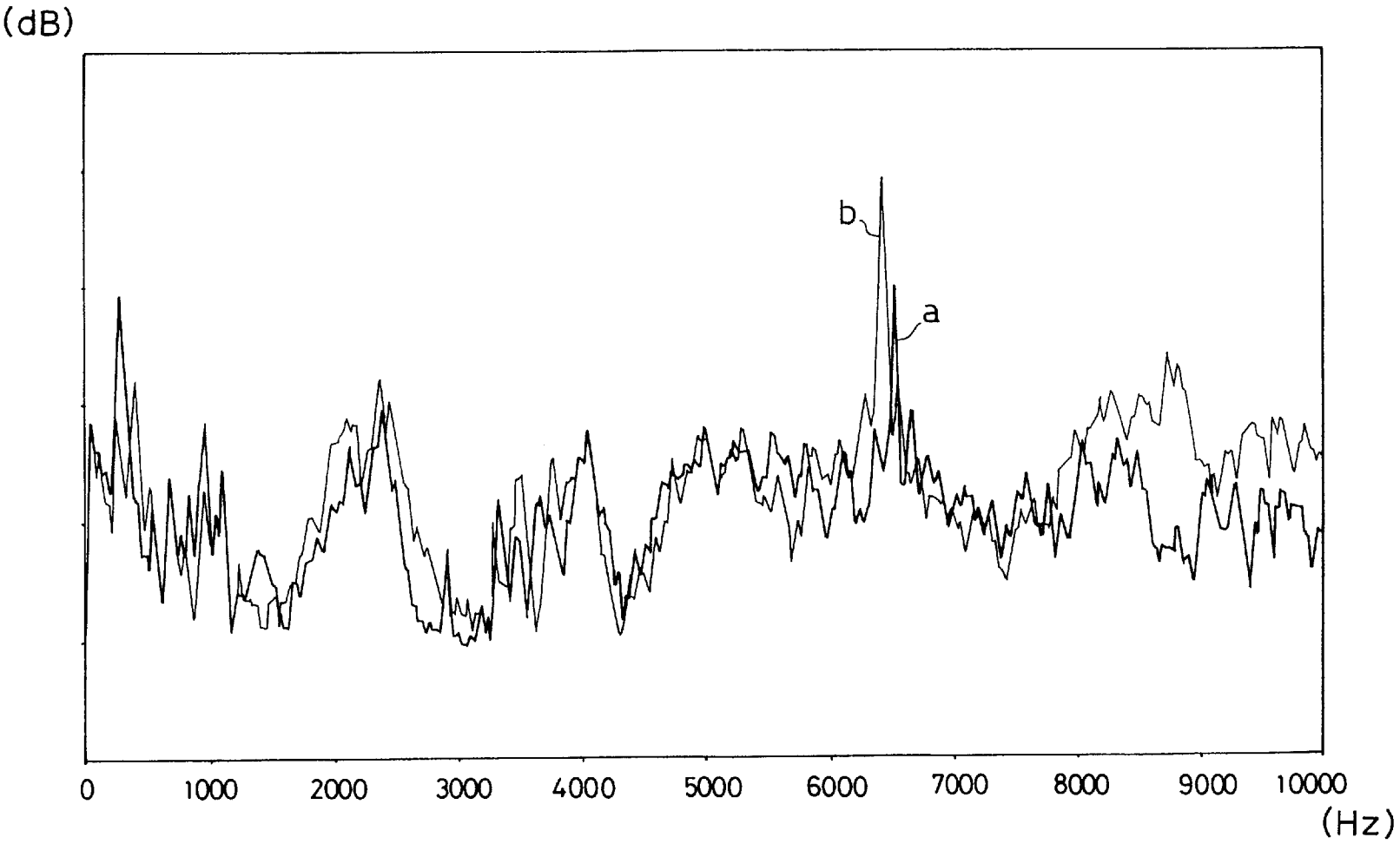
FIG. 4 is a characteristic chart showing sound pressure waveforms of impeller noise in which frequency is shown by the abscissa and sound pressure is shown by the ordinate.

FIG. 4 is a chart showing sound pressure waveforms of the impeller noise in the fuel pump measured by means of FFT analyzer. A solid line a shows a sound pressure waveform of the fuel pump unit of the first embodiment, and a thinner solid line b shows that of a conventional fuel pump unit. As should be apparent from FIG. 4, the sound pressure corresponding to impeller noise (around 6400 Hz) is greatly reduced by the fuel pump unit of the first embodiment compared with the conventional fuel pump unit.

[Second Embodiment]

Figure 5A:
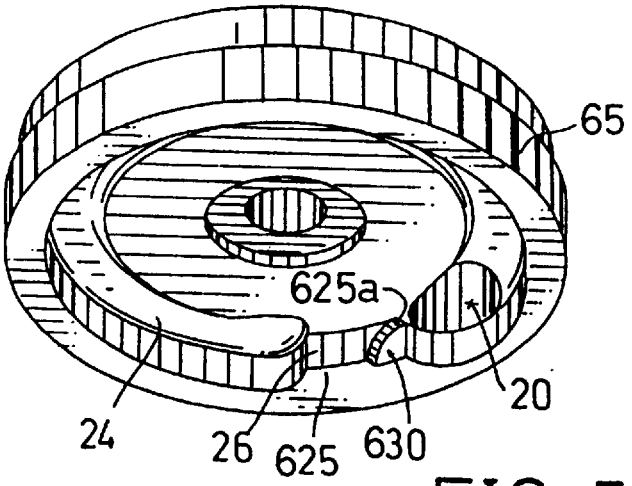
FIGS. 5(*a*) to 5(*c*) are explanatory views of a pump cover according to a second embodiment of the present invention.
Figure 5B:
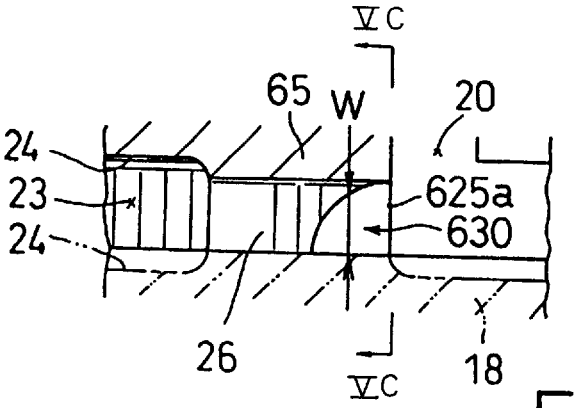
Figure 5C:
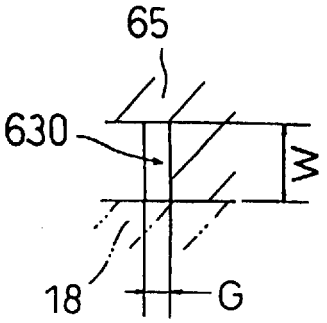

FIG. 5 is an explanatory view of a fuel pump unit according to a second embodiment of the present invention. FIG. 5(*a*) is a schematic view of a pump cover 65 as viewed from the underside thereof, and FIG. 5(*b*) is an inside view of the partition wall , and FIG. 5(*c*) is a sectional view taken along line C—C of FIG. 5(*b*).

As best shown in FIGS. 5(*a*) to 5(*c*), in a fuel pump unit of the second embodiment, an inner peripheral edge of a cutout slot 630 having a radial depth of G is made into an arcuate shape instead of the linear shape of the first embodiment so that the axial width W of the cutout slot 630 is gradually reduced from the outlet hole end 625*a* in the circumferentially downstream direction.

With the second embodiment, substantially the same operation and effects as those of the first embodiment are obtained.

When the present invention is applied to a multi-stage fuel pump unit in which a plurality of pump sections each having an impeller 21 are provided in sequence, the outlet hole 20 of the first-stage pump is also used as an inlet hole of the second-stage pump. Further, the construction described above is applied equally to each pressurizing passage 23 of each-stage pump. Even when the construction is applied only to the pressurizing passage 23 of the first-stage pump, the impeller noise is considerably reduced. However, the noise is greatly reduced when the construction is applied to all the pressurizing passages 23 of all the stage pumps.

From the foregoing description, it can be appreciated that the present invention avoids sudden cut-off of the spiral vortex of the fuel caused by the partition wall of the pump chamber and reduces the impeller noise, thus permitting noise reduction of the fuel pump.

While the invention has been described with reference to preferred embodiments thereof, it is to be understood that modifications or variations may be easily made without departing from the scope of the present invention which is defined by the appended claims.

What is claimed is:

1. In a low impeller noise fuel pump unit including;

a substantially disc-shaped rotatable impeller having an axis;

a pump casing for accommodating said impeller, said pump casing having a pressurizing passage surrounding an outer peripheral edge of said impeller and extending along said outer peripheral edge from an upstream end to a downstream end, an inlet hole communicating with the upstream end of said pressurizing passage, an outlet hole communicating with the downstream end of the pressurizing passage, and a partition wall formed at a location circumferentially upstream of the upstream end and downstream of the downstream end of the pressurizing passage;

the improvement comprising:

a cutout slot formed at an end of said partition wall facing said outlet hole, the width of said cutout slot in the direction of the impeller axis being gradually reduced as said cutout slot extends from an end of said partition wall in a circumferentially downstream direction.

2. The fuel pump unit as defined in claim 1, wherein said cutout slot has an inner peripheral edge formed to a straight line.

3. The fuel pump unit as defined in claim 2, wherein said straight line is inclined at 45° to the axis of the impeller.

4. The fuel pump as defined in claim 1, wherein said cutout slot has an inner peripheral edge formed into an arc.

5. The fuel pump as defined in claim 1, wherein the depth of said cutout slot in a redial direction is constant.

6. In a low impeller noise fuel pump unit including:

a substantially disc-shaped rotatable impeller having a rotating axis;

a pump casing for accommodating said impeller, said pump casing formed with a pressurizing passage having an upstream and a downstream end, said pressurizing passage surrounding an outer peripheral edge of said impeller and extending along said outer peripheral edge from the upstream end to the downstream end, an inlet hole communicating with the upstream end of said pressurizing package, an outlet hole communicating with the downstream end of the pressurizing passage, and a partition wall formed at a location circumferentially upstream of the upstream end and downstream of the downstream end of the pressurizing passage;

the improvement comprising:

a cutout slot formed at an end of said partition wall facing said outlet hole, the circumferential length of said cutout slot changing in the direction of the rotating axis.

* * * * *